US006406073B1

(12) United States Patent
Watanabe

(10) Patent No.: US 6,406,073 B1
(45) Date of Patent: Jun. 18, 2002

(54) VEHICLE DOOR LATCH DEVICE WITH DOUBLE ACTION MECHANISM

(75) Inventor: Hirofumi Watanabe, Yamanashi-ken (JP)

(73) Assignee: Mitsui Kinzoku Kogyo Kabushiki Kaisha, Tokyo (JP)

( * ) Notice: Subject to any disclaimer, the term of this patent is extended or adjusted under 35 U.S.C. 154(b) by 83 days.

(21) Appl. No.: 09/665,662

(22) Filed: Sep. 20, 2000

(30) Foreign Application Priority Data

Sep. 21, 1999 (JP) ..... 11-267182

(51) Int. Cl.[7] ..... E05C 3/06
(52) U.S. Cl. ..... 292/216; 292/DIG. 23
(58) Field of Search ..... 292/336.3, 216, 292/201, DIG. 23; 70/264

(56) References Cited

U.S. PATENT DOCUMENTS 5,100,185 A * 3/1992 Menke ..... 292/216
5,106,135 A * 4/1992 Menke ..... 292/216
5,653,484 A * 8/1997 Brackmann ..... 292/216
5,971,449 A * 10/1999 Rogers ..... 292/216
6,343,817 B1 * 2/2002 Watanabe ..... 292/216

FOREIGN PATENT DOCUMENTS

DE 43 13 248 C2 10/1996

* cited by examiner

*Primary Examiner*—Gary Estremsky
(74) *Attorney, Agent, or Firm*—Browdy and Neimark

(57) ABSTRACT

A vehicle door latch device comprises an open lever (24) for connection to an outside open handle (25), a lock lever (34) for connection to an inside lock button (36) through a rod (101), an over-center spring (42) for elastically keeping the lock lever (34) in one of an unlocked position (U) and a locked position (L), a double action mechanism (27) for connection to an inside open handle (28), and an antitheft mechanism (100) having an antitheft spring (105) with elasticity weaker than elasticity of the over-center spring (42). The antitheft spring (105) is arranged to be compressed without displacing the lock lever (34) from the locked position (L) to the unlocked position (U) when the rod (101) is moved in an unlocking direction by an illegal access while the lock lever (34) is being in the locked position (L).

4 Claims, 9 Drawing Sheets

FIG. 3
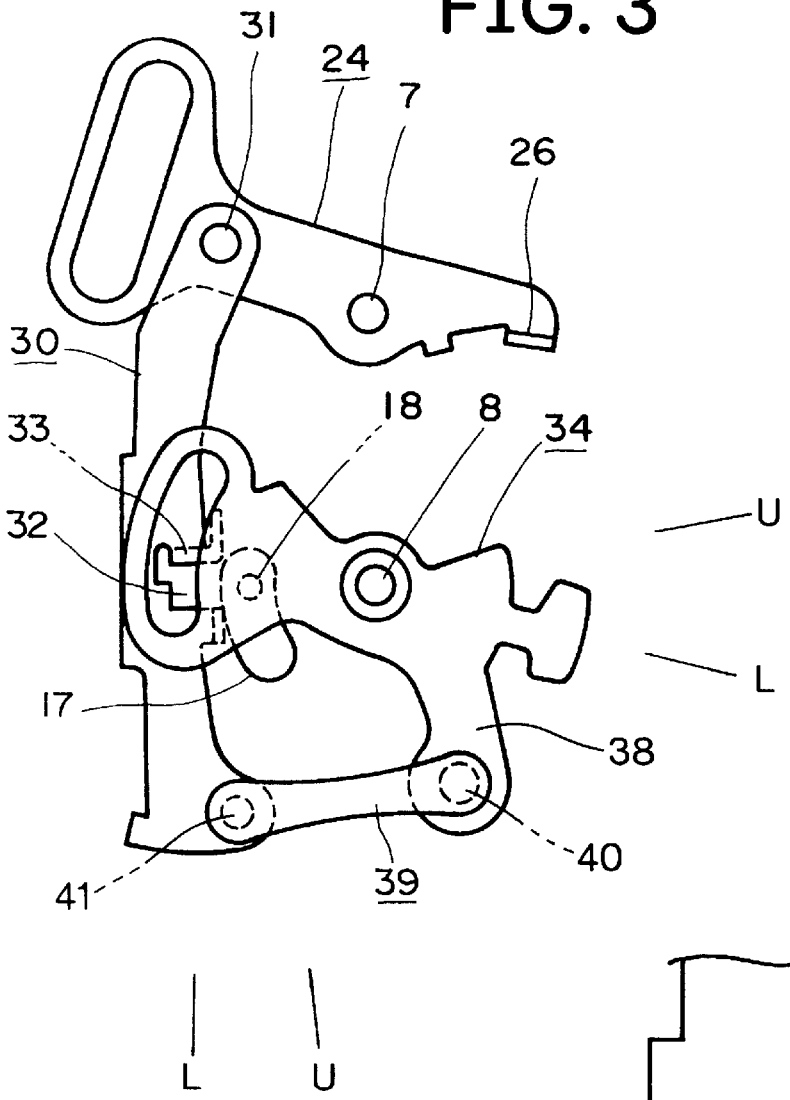
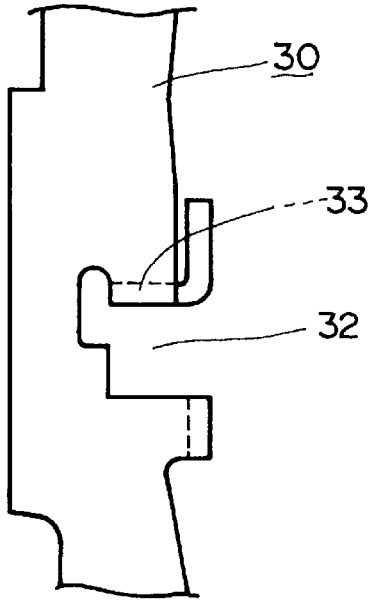
FIG. 4

FIG. 9
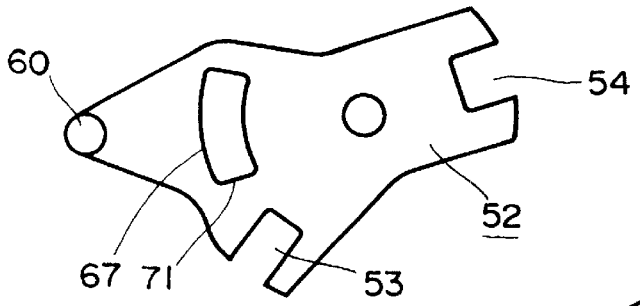
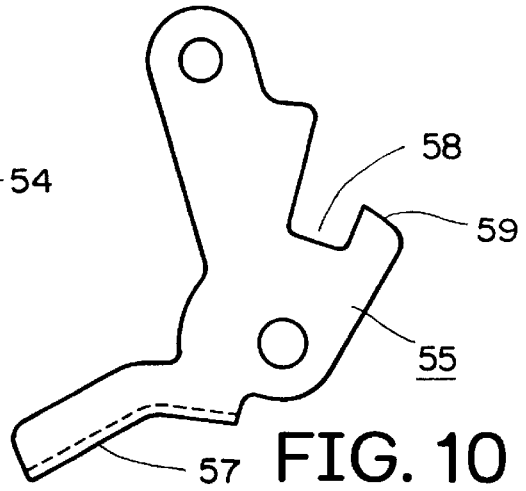
FIG. 10
FIG. 11
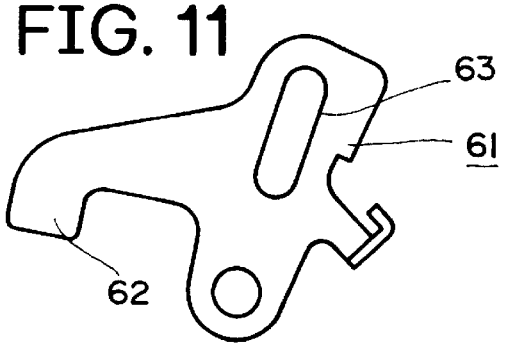
FIG. 13
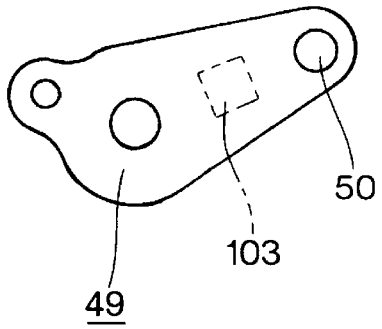
FIG. 12
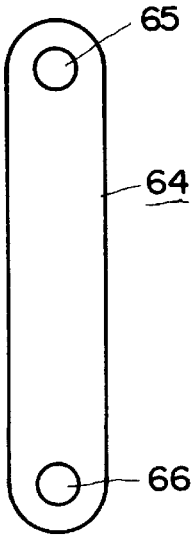
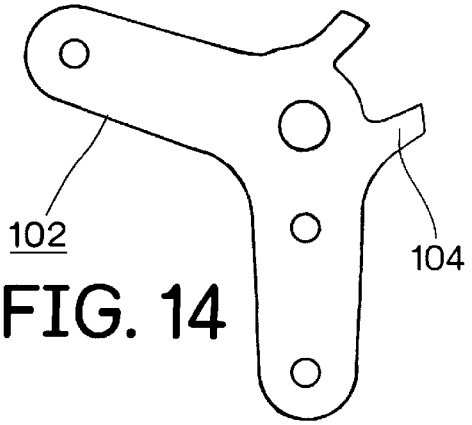
FIG. 14

FIG. 15
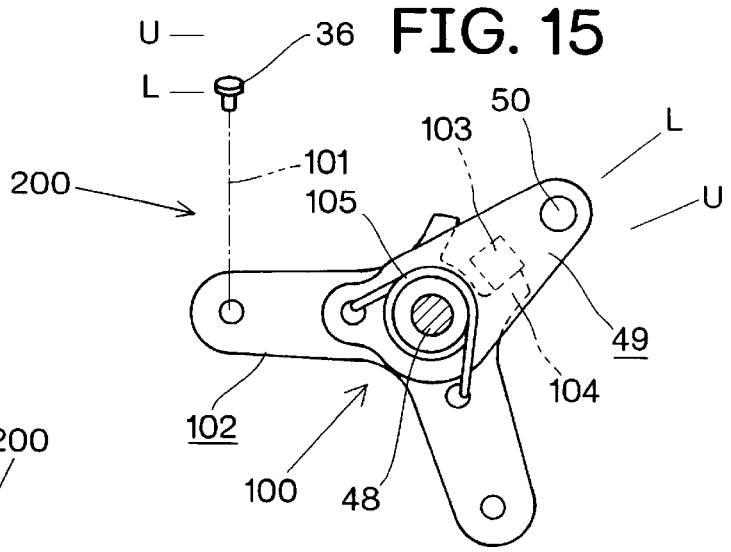
FIG. 16
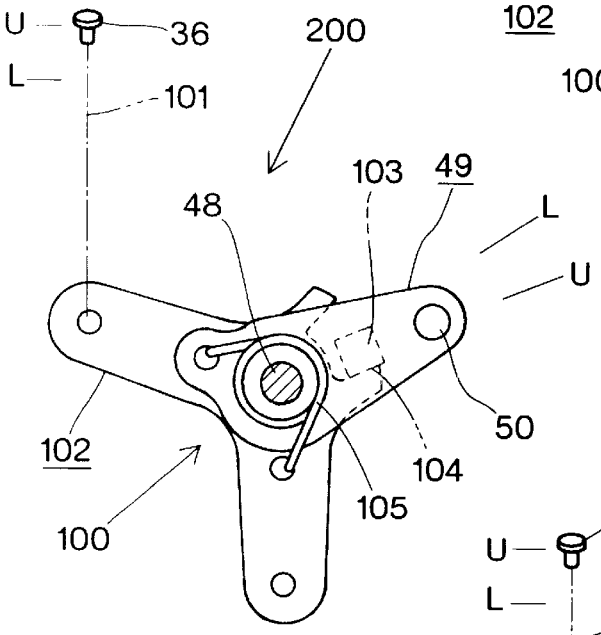
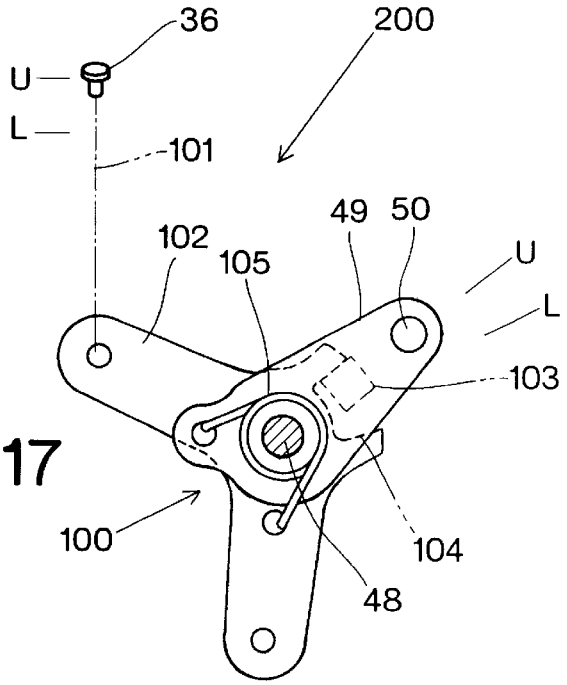
FIG. 17

VEHICLE DOOR LATCH DEVICE WITH DOUBLE ACTION MECHANISM

TECHNICAL FIELD

The present invention relates to a vehicle door latch device, and more particularly, to a vehicle door latch device with a double action mechanism.

PRIOR ART

German Patent DE 4,313,248 C2 discloses a double action mechanism (hereafter, referred to as a DA mechanism) provided in a door latch device for the purpose of improving the performance of crime prevention of the door latch device. The DA mechanism can be called an improved mechanism of a previously well known one-motion door opening mechanism. The conventional one-motion mechanism is approximately simultaneously capable of restoring the latch device from a locked state to an unlocked state and opening the door, when an inside open handle of the door is operated in a case where the door latch device is in the locked state.

On the contrary, the DA mechanism merely restores the latch device from the locked state to the unlocked state without opening the door, when the door-opening operation of the inside open handle is performed in the locked state. The DA mechanism opens the door in accordance with the door-opening actuation of the inside open handle only when the latch device is in the unlocked state. Accordingly, in order to open the locked door having a latch device with a DA mechanism by the inside open handle, both a first door-opening actuation of the inside open handle for restoring the latch device to the unlocked state from the locked state and a second door-opening actuation of the inside handle for releasing the latch device are necessary. Thus, the DA mechanism requires the double action of the inside open handle when opening the door, so that it can improve the performance of crime prevention of the door latch device.

In addition, in a door equipped with the latch device with the DA mechanism, an inside lock button which is provided on an inside surface of the door may be arranged such that it can be used only when switching the latch device from the unlocked state to the locked state. In other words, in some cases, the inside lock button has no function of switching the latch device from the locked state to the unlocked state. In such a case, the unlocking of the latch device is performed by the first door-opening actuation of the inside open handle. By removing the function of the unlocking operation from the inside lock button, the performance of crime prevention of the door can furthermore be improved. In order to remove the function of the unlocking operation from the inside lock button, in the prior art, the inside lock button in the locked position is hidden inside the fancy board or trim board of the door, so that the inside lock button cannot be picked by fingers.

The inside lock button in the locked position has a high performance of crime prevention against an illegal access from the outside since it is hidden in the fancy board, but the performance of crime prevention of the connecting portion between the inside lock button and the latch device provided in the inside space of the door remains as it has been in the prior art.

SUMMARY OF THE INVENTION

Accordingly, it is an object of the present invention to provide a latch device with a DA mechanism in which the performance of crime prevention of the connecting portion between the inside lock button and the lock lever of the latch device is improved.

In order to attain this object, in the present invention, an antitheft mechanism is provided between the inside lock button and the lock lever, which does not transmit the unlocking movement of the inside lock button to the lock lever.

BRIEF DESCRIPTION OF THE DRAWINGS

FIG. 3 is a segmentary rear view of the latch assembly in a locked state;

FIG. 4 is a partially enlarged view of an open link of the latch assembly;

FIG. 9 is a side view of a sub lock lever of the latch assembly;

FIG. 10 is a side view of the inner lever of the latch assembly;

FIG. 11 is a side view of a release lever of the latch assembly;

FIG. 12 is a side view of a slide link of the latch assembly;

FIG. 13 is a side view of an actuator lever of the latch assembly;

FIG. 14 is a side view of an intermediate lever of the latch assembly;

FIG. 15 is a side view showing a coupling mechanism between the latch assembly and an inside lock button in the locked state;

FIG. 16 is a side view showing the coupling mechanism in the unlocked state; and FIG. 17 is a side view showing the coupling mechanism when receiving an illegal access.

DESCRIPTION OF THE PREFERRED EMBODIMENT

Figure 1:
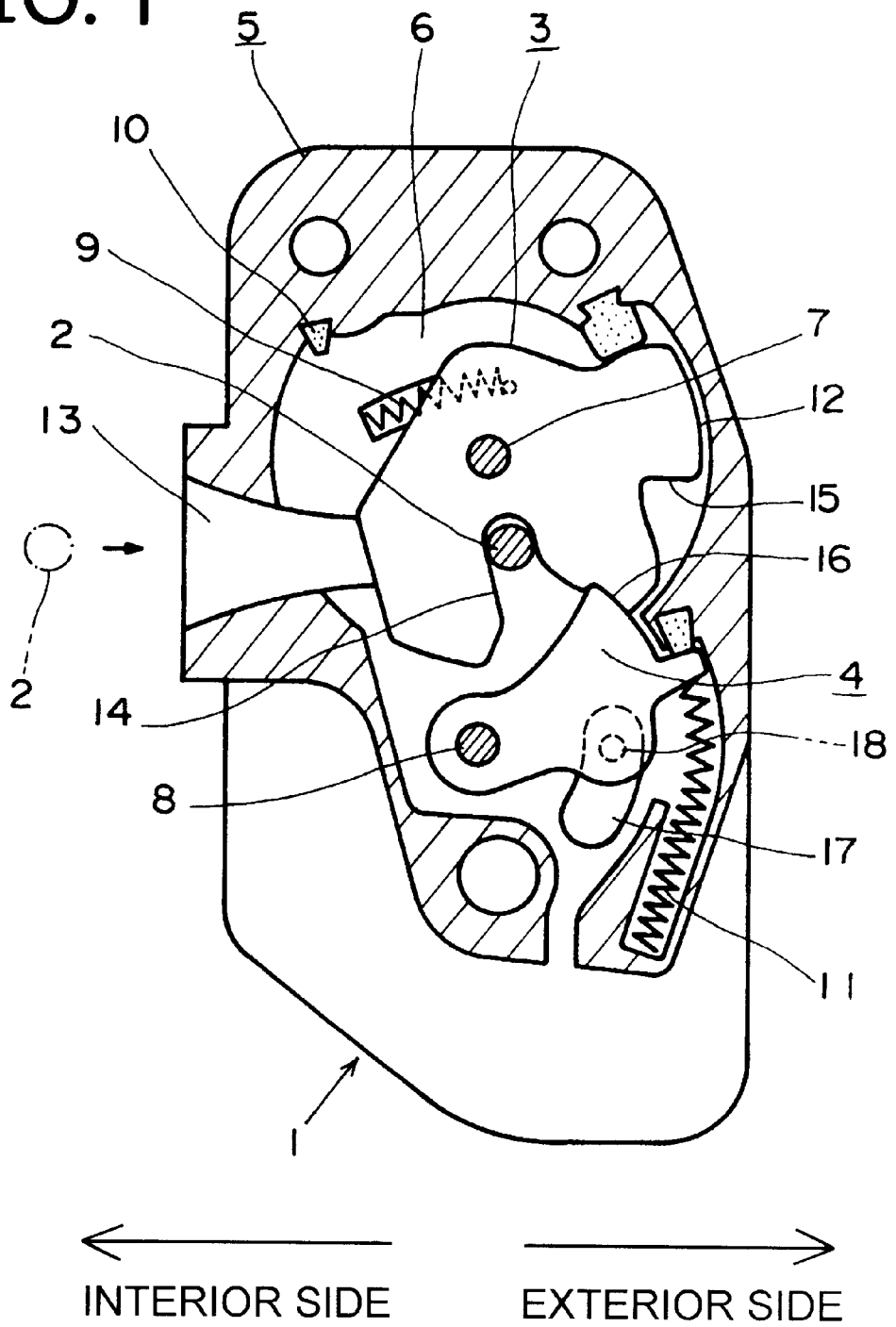
FIG. 1 is a front view of a latch assembly of a vehicle door latch device according to the present invention.

An embodiment of the present invention will be described by referring to drawings. The vehicle door latch device according to the present invention comprises a latch assembly 1 which is attached to a vehicle door (not shown), and a striker 2 which is fixed to a vehicle body (not shown). The latch assembly 1 comprises a latch 3 which is engaged with the striker 2 when the door is closed, and a ratchet 4 which holds the engagement of the latch 3 and the striker 2. The latch 3 is rotatably received by a latch shaft 7 in an upper portion of a concave portion 6 formed in a front surface of a synthetic resin latch body 5, and the ratchet 4 is rotatably received by a ratchet shaft 8 in a lower portion of the concave portion 6.

The latch 3 is urged in the clockwise direction in FIG. 1 by a spring force of a latch spring 9. When the door is in an open position, the latch 3 is located in an unlatched position and is brought into contact with a damper 10 on the latch body 5 by the spring force of the spring 9. The ratchet 4 is urged in the counterclockwise direction by a spring force of a ratchet spring 11. The ratchet 4 is brought into contact with an unlatching portion 12 of the latch 3 when the door is in an open position. When the door moves from the open position toward a full-closed position, the striker 2 enters a horizontal passage 13 formed in the latch body 5 to be brought into contact with a U-shaped groove 14 of the latch 3, thereby the latch 3 turns counterclockwise against the spring force of the latch spring 9. When the latch 3 turns from the unlatched position to a half-latched position, the ratchet 4 is engaged with a first step 15 of the latch 3 and the door reaches a half-closed position. Furthermore, when the latch 3 reaches a full-latched position shown in FIG. 1, the ratchet 4 is engaged with a second step 16 of the latch 3 and the door is held in the full-closed position.

The ratchet 4 has a ratchet pin 18 which projects onto the rear side of the latch body 5 through an opening 17 of the latch body 5.

Figure 5:
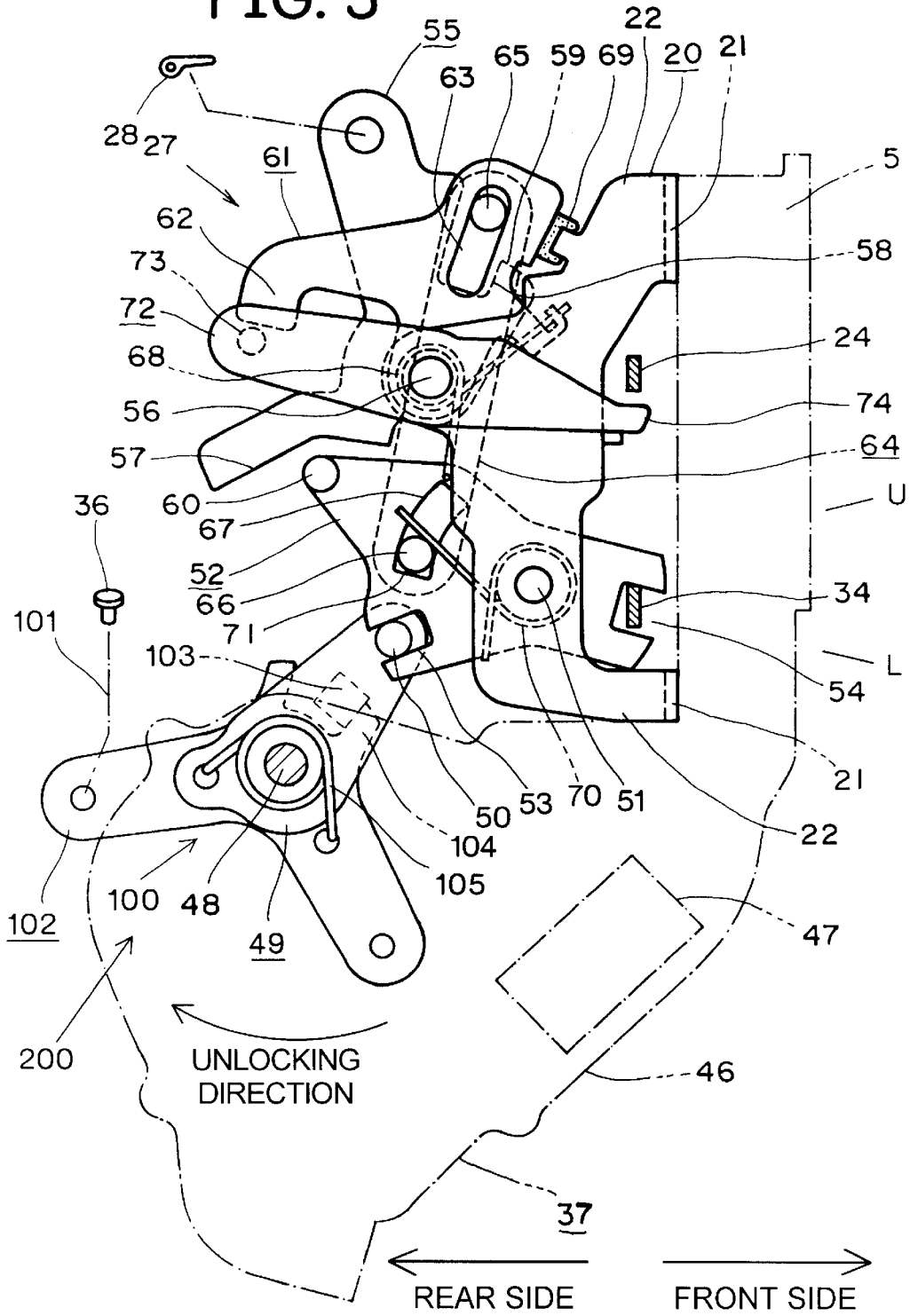
FIG. 5 is a side view of the latch assembly in the locked state.

To the rear portion of the latch body 5, as shown in FIG. 5, a metal back plate 20 is attached. The back plate 20 comprises a parallel plate 21 which is substantially in parallel with the rear surface of the latch body 5, and a bent plate 22 which is angled to extend rearward from the interior side edge of the parallel plate 21. The rear side portion of the latch body 5 is formed with a horizontal bulged portion 23 (FIG. 2) which projects rearward from the rear of the latch body 5. The horizontal passage 13 is defined by the space on the front side of the horizontal bulged portion 23.

Figure 2:
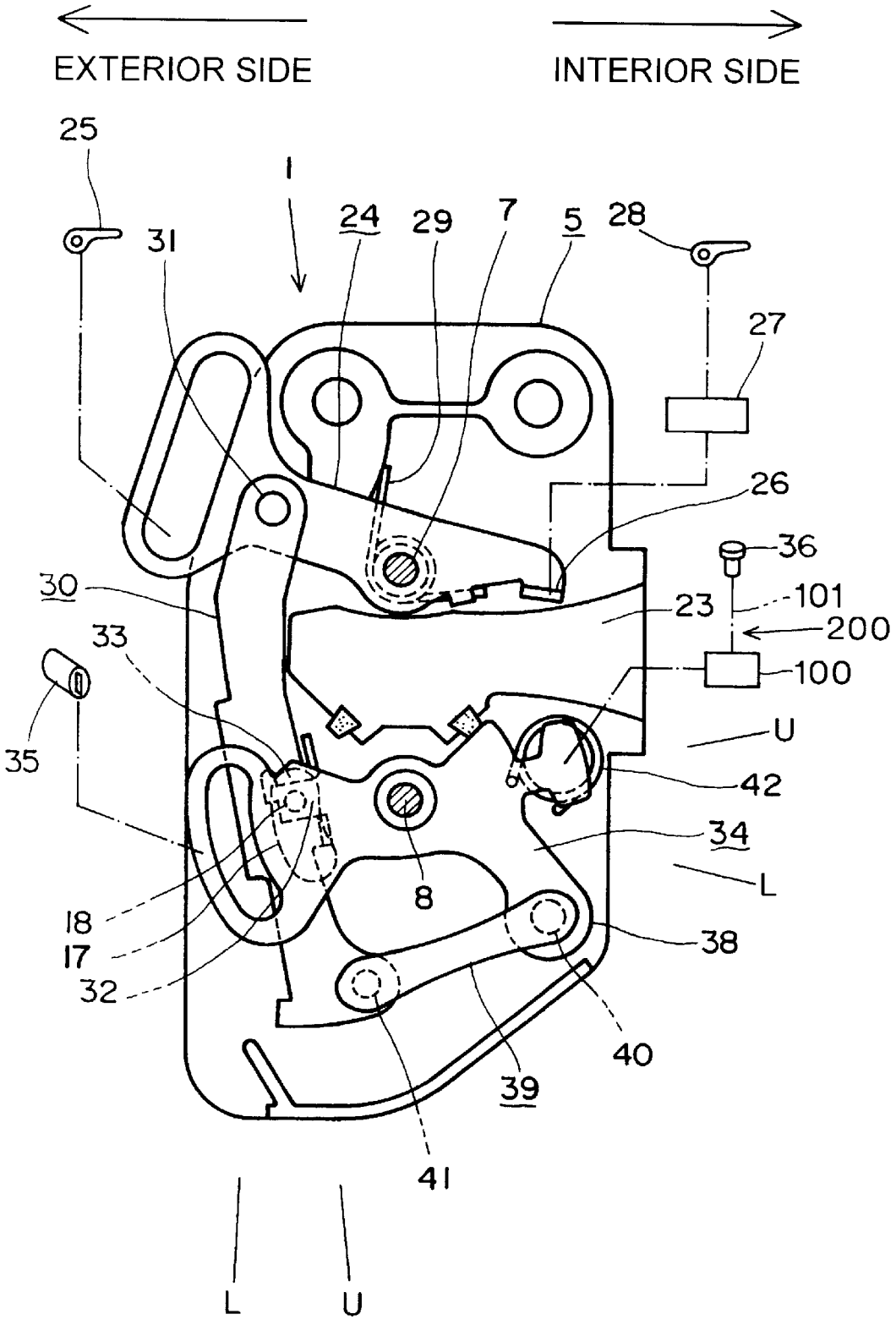
FIG. 2 is a rear view of the latch assembly in an unlocked state.

As shown in FIG. 2, at the rear side of the latch body 5 above the horizontal bulged portion 23, an open lever 24 is rotatably attached by the latch shaft 7. An outside open handle 25 of the door is connected to the exterior side portion of the open lever 24. The interior side portion of the open lever 24 is formed with a contact portion 26 which is operatively connected to an inside open handle 28 of the door through a double action mechanism 27 (hereafter DA mechanism 27) described later. The open lever 24 is urged in the clockwise direction in FIG. 2 by a spring force of a spring 29, and is turned counterclockwise by the door-opening actuation of the open handles 25, 28. An upper end of a vertically extending elongated open link 30 is connected to the exterior side portion of the open lever 24 by a pin 31. The open link 30 is positioned on the exterior side with respect to the horizontal bulged portion 23 so that the open link 30 does not overlap with the horizontal bulged portion 23 in the back-and-forth direction of the latch body 5. In the middle portion of the open link 30, a notch 32 (FIG. 6) is formed. The upper edge of the notch 32 is formed with a horizontal contact surface 33 which is angled toward the latch body 5.

At the rear side of the latch body 5 below the horizontal bulged portion 23, a lock lever 34 is rotatably attached by the ratchet shaft 8. The lock lever 34 has an exterior side portion which is connected to a key cylinder 35 of the door, and an interior side portion which is connected to an inside lock button 36 of the door through a coupling mechanism 200 including an antitheft mechanism 100 and a rod 101. The configuration to be described later of the antitheft mechanism 100 is the feature of the present invention. The lock lever 34 has a diagonally downward extending arm 38 which is connected to a right end of an approximately horizontal connecting link 39 by a pin 40. A left end of the connecting link 39 is connected to the lower end of the open link 30 by a pin 41.

The lock lever 34 is displaceable between an unlocked position U shown in FIG. 2 and a locked position L shown in FIG. 3 around the ratchet shaft 8 as a center by the actuation of one of the key cylinder 35, the lock button 36, and an actuator unit 37 described later. This displacement of the lock lever 34 makes the lower portion of the open link 30 move left and right around the pin 31 as a center, and the lock lever 34 is similarly displaced between the unlocked position U and the locked position L. The lock lever 34 (the open link 30) is held by a spring force of an over-center spring 42 at one of the unlocked position U and the locked position L with respect to the dead point of the spring 42 as a boundary.

When the open link 30 is located at the unlocked position U as shown in FIG. 2, the horizontal contact surface 33 formed on the notch 32 is engageably opposed to the ratchet pin 18 in the vertical direction. Accordingly, the horizontal contact surface 33 is brought into contact with the ratchet pin 18 to turn the ratchet 4 clockwise in FIG. 1 against the spring force of the ratchet spring 11 when the open link 30 is lowered by the actuation of the open lever 24, thereby the latch 3 is released from the restriction by the ratchet 4 so as to open the door.

When the open link 30 is shifted to the locked position L by the locking actuation of the lock lever 34, the horizontal contact surface 33 moves to the side of the ratchet pin 18, as shown in FIG. 3, thereby the engageable state therebetween is cancelled. Accordingly, in the locked state of FIG. 3, the door cannot be opened even if the open link 30 is lowered.

As shown in FIG. 5, the actuator unit 37 is attached to the latch body 5 or the back plate 20. The actuator unit 37 has an actuator shaft 48 which is outwardly projected from an actuator case 46 and which is rotated by the power of a built-in motor 47.

Onto the bent plate 22 of the back plate 20, an sub lock lever 52 (FIG. 9) is pivoted by a support shaft 51 which extends in the left-and-right direction of the latch body 5. A hook 53 and a forked portion 54 are formed on the sub lock lever 52. The forked portion 54 is engaged with the interior side portion of the lock lever 34, so that the sub lock lever 52 and the lock lever 34 are displaced between the unlocked position U and the locked position L as one piece against the elasticity of the over-center spring 42.

The coupling mechanism 200 for connecting the inside lock button 36 and the main lock lever 34 will be described. The antitheft mechanism 100 of the coupling mechanism 200 has, as shown in FIG. 5, an actuator lever or a lock side lever 49 (FIG. 13) which is fixed to an exposed end of the actuator shaft 48, and an intermediate lever or a button side lever 102 (FIG. 14) which is rotatably supported by the actuator shaft 48. The intermediate lever 102 can rotate independently from the actuator shaft 48. The actuator lever 49 has at the tip end thereof a projection 50 engaged with the hook 53 of the sub lock lever 52, so that the actuator lever 49 is displaceable integrally with the main lock lever 34 through the sub lock lever 52. When rotating the actuator lever 49 fastened to the actuator shaft 48 by the power of the built-in motor 47, the sub lock lever 52 and the main lock lever 34 are integrally displaced to the unlocked position U or the locked position L against the elasticity of the over-center spring 42. One end of the intermediate lever 102 is connected to the inside lock button 36 through the rod 101.

The actuator lever 49 has a projection 103, and the intermediate lever 102 has a contact portion 104 with which the projection 103 can be engaged. An antitheft spring 105 is provided between the actuator lever 49 and the intermediate lever 102. The elasticity of the antitheft spring 105 urges the intermediate lever 102 in the direction of the counterclockwise rotation (locking rotation) in FIG. 5, and urges the actuator lever 49 in the direction of the clockwise rotation (unlocking rotation). Consequently, usually, the projection 103 of the actuator lever 49 comes into contact with the contact portion 104 of the intermediate lever 102. Here, it is important that the elasticity of the antitheft spring 105 should be weaker than the elasticity of the over-center spring 42 that keeps the lock lever 34 in either the unlocked position U or the locked position L.

In the locked state of FIGS. 5 and 15, when the actuator lever 49 is rotated clockwise by the unlocking actuation of the actuator unit 37, the lock lever 34 is displaced to the unlocked position U through the sub lock lever 52. At the same time, the projection 103 of the actuator lever 49 pushes the contact portion 104 of the intermediate lever 102 to rotate the intermediate lever 102 clockwise, and the inside lock button 36 is, as shown in FIG. 16, restored to the unlocked position U from the locked position L through the rod 101. When the lock lever 34 is displaced to the unlocked position U from the locked position L by the unlocking actuation of the key cylinder 35, the actuator lever 49 is rotated clockwise in FIG. 5 through the sub lock lever 52, and then the projection 103 pushes the contact portion 104 to rotate the intermediate lever 102 clockwise, thereby the inside lock button 36 is restored to the unlocked position U from the locked position L.

Figure 6:
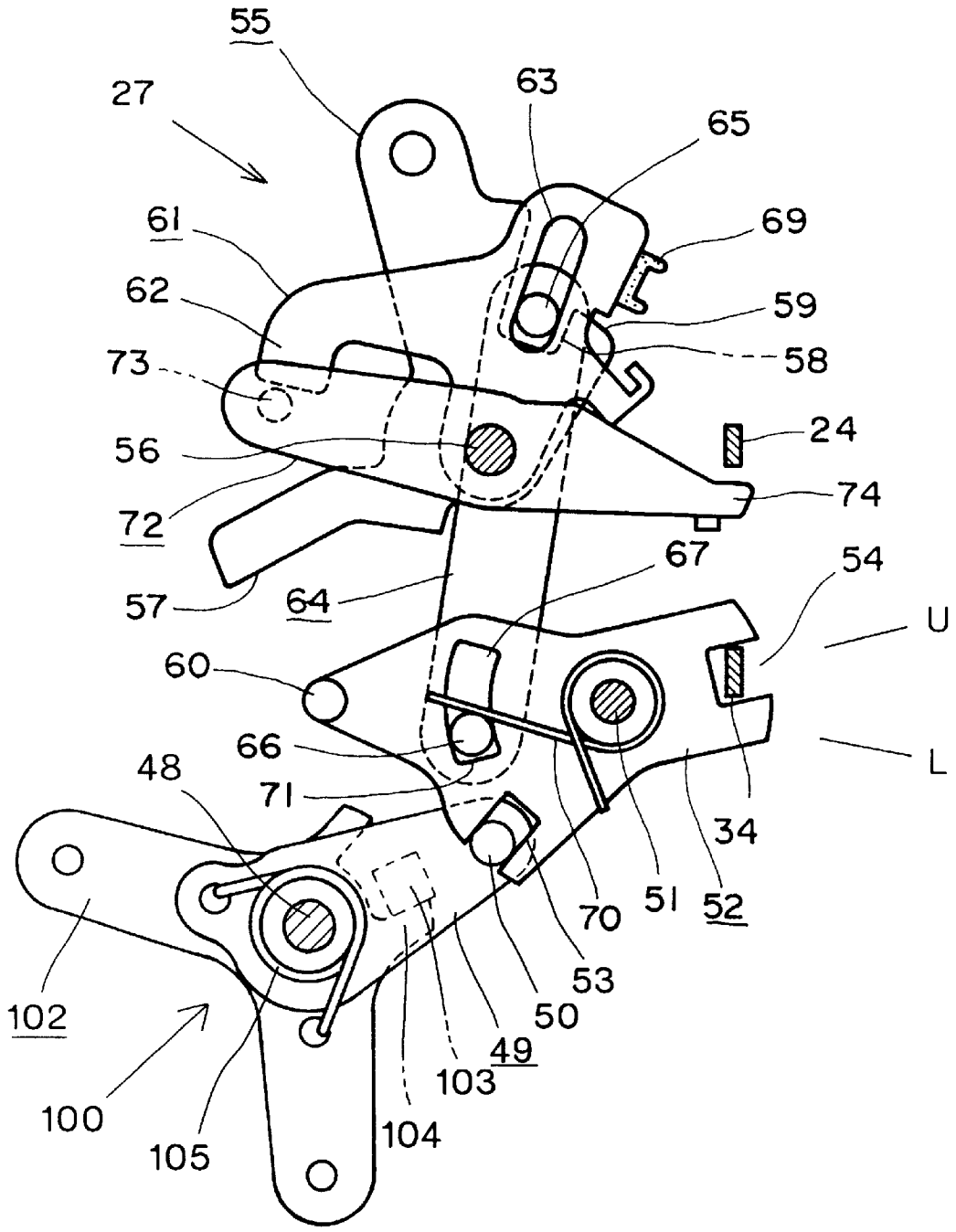
FIG. 6 is a segmentary side view of the latch assembly in the unlocked ate.

Furthermore, in the unlocked state of FIGS. 6 and 16, when the actuator lever 49 is rotated counterclockwise by the locking actuation of the actuator unit 37, the lock lever 34 is displaced to the locked position L through the sub lock lever 52. At this moment, the projection 103 of the actuator lever 49 moves in the direction of being separated from the contact portion 104, but the intermediate lever 102 is urged in the counterclockwise direction (locking direction) by the elasticity of the antitheft spring 105, and therefore, the intermediate lever 102 is rotated counterclockwise following the movement of the actuator lever 49, and thereby the inside lock button 36 is displaced to the locked position L from the unlocked position U as shown in FIG. 15. When the lock lever 34 is displaced to the locked position L from the unlocked position U by the locking actuation of the key cylinder 35, the rotation of the actuator lever 49 is similarly also transmitted to the intermediate lever 102 through the elasticity of the antitheft spring 105, and the inside lock button 36 is then switched to the locked position L.

As mentioned above, in the switching of the device to the unlocked state U from the locked state, the rotation of the actuator lever 49 is directly transmitted to the intermediate lever 102 through the mechanical contact between the projection 103 and the contact portion 104, but in the switching to the locked state from the unlocked state, the rotation of the actuator lever 49 is transmitted to the intermediate lever 102 through the elasticity of the antitheft spring 105.

In the locked state of FIGS. 5 and 15, when any one of the inside lock button 36, the rod 101, and the intermediate lever 102 receives an illegal access for unlocking the device, the intermediate lever 102 is rotated clockwise, and then the unlocking rotational force of the intermediate lever 102 is transmitted to the actuator lever 49 through the antitheft spring 105. But, the actuator lever 49 is held in the locked position L by the elasticity of the over-center spring 42 having an elasticity stronger than that of the antitheft spring 105. Therefore, the antitheft spring 105 cannot rotate the actuator lever 49 from the locked position L to the unlocked position U and the antitheft spring 105 is merely compressed as shown in FIG. 17, even if the intermediate lever 102 is rotated in the unlocking direction by the illegal access. Thus the locked state of the latch assembly 1 is held. If the inside lock button 36 is displaced to the unlocked position U by the illegal access, it will be restored to the locked position L by the restoring force of the antitheft spring 105 after the latch assembly 1 is released from the illegal access.

Next, the double action mechanism 27 will be described. As shown in FIG. 5, the DA mechanism 27 is attached to the bent plate 22, and is operatively provided among the inside open handle 28 and the open lever 24 and the lock lever 34. The DA mechanism 27 makes the open lever 24 turn so as to open the door when the inside open handle 28 is operated while the lock lever 34 is located in the unlocked position U. However, if the inside handle 28 is operated to open the door while the lock lever 34 is located in the locked position L, the DA mechanism 27 does not open the door, but it shifts the lock lever 34 from the locked position L to the unlocked position U. That is, the DA mechanism 27 restores the lock lever 34 (and the inside lock button 36) to the unlocked position U by a first door-opening actuation of the inside open handle 28, and by a second door-opening actuation of the inside handle 28, the DA mechanism 27 opens the door. The double action consisting of the first and second door-opening actuations required by the DA mechanism 27 improves the antitheft performance of the door latch device.

The structure of the DA mechanism 27 will be described in detail. The DA mechanism 27 has an inner lever 55 (FIG. 10) which is pivoted to the bent plate 22 by a mounting shaft 56 in parallel with the support shaft 51 and which is connected to the inside open handle 28. When the inside handle 28 is not operated, the inner lever 55 is held at its initial position or rest position shown in FIG. 5 by a spring (not shown) provided at the inside handle 28. The inner lever 55 has a push arm 57, a hook 58, and a blocking surface 59 communicating with one end of the hook 58. The push arm 57 is engageably opposed to an engaging projection 60 of the sub lock lever 52 positioned in the locked position L. The arm 57 is brought into contact with the engaging projection 60 to turn the sub lock lever 52 in the counterclockwise (unlocking) direction so as to displace the main lock lever 34 from the locked position L to the unlocked position U when the inner lever 55 is turned counterclockwise.

Onto the mounting shaft 56, a release lever 61 (FIG. 11) is pivoted such that it may overlap with the inner lever 55. The release lever 61 is urged in the clockwise direction in FIG. 5 by a spring 68, and is usually brought into contact with a stopper 69 attached to the bent plate 22. The release lever 61 has a contact arm 62, and an elongated hole 63 which partially overlaps with the hook 58 and which extends in the radial direction of the mounting shaft 56. A slide pin 65 is slidably engaged with the elongated hole 63. The slide pin 65 is formed at an upper end of a slide link 64 (FIG. 12) which extends in the vertical or up-and-down direction of the latch body 5. The slide link 64 has, at the lower end thereof, a connecting pin 66 which is slidably engaged with a circular arc slot 67 formed on the sub lock lever 52 around the support shaft 51 as a center. Between the slide link 64 and the sub lock lever 52, a spring 70 for urging the slide link 64 downward is provided. The spring 70 has a first leg engaged with connecting pin 66 and a second leg engaged with the sub lock lever 52.

In the locked state of FIG. 5, the connecting pin 66 of the slide link 64 is brought into contact with a lower end 71 of the circular arc slot 67 by the elasticity of the spring 70, and the slide pin 65 is positioned at the upper portion in the elongated hole 63 of the release lever 61 and is disengaged from the hook 58 of the inner lever 55 so as not to transmit the rotational movement of the inner lever 55 to the release lever 61. This position of the slide link 64 where the slide pin 65 is disengaged from the hook 58, is called a non-connective position.

In the above locked state, when unlocking the lock lever 34 by using the key cylinder 35, the sub lock lever 52 is turned in the counterclockwise (unlocking) direction in FIG. 5 through the main lock lever 34, and is then displaced to the unlocked position U as shown in FIG. 6. In addition, since the connecting pin 66 is pressed against the lower end 71 of the slot 67 of the sub lock lever 52 by the spring force of the spring 70, the slide link 64 is moved downward, following the unlocking movement of the sub lock lever 52, and the slide pin 65 is then engaged with the hook 58 of the inner lever 55, so that the slide pin 65 can transmit the rotational movement of the inner lever 55 to the release lever 61. This position of the slide link 64 where the slide pin 65 is engaged with the hook 58, is called a connective position.

To the mounting shaft 56, a sub inner lever 72 is also pivoted. The sub inner lever 72 has, at one end thereof, a sub projection 73 which is engageable with the contact arm 62 of the release lever 61, and has, at the other end thereof, an engaging portion 74 which is engageably opposed to the interior side portion of the open lever 24. When the release lever 61 is turned counterclockwise, the contact arm 62 of the release lever 61 is brought into contact with the sub projection 73 of the sub inner lever 72 to turn the sub inner lever 72 counterclockwise. Then, the engaging portion 74 at the lower portion of the sub inner lever 72 is brought into contact with the interior side portion of the open lever 24 and turns the open lever 24 so as to open the door.

Between the sub inner lever 72 and the release lever 61, a well known child-lock mechanism can be provided, if desired. It should be noted that the sub inner lever 72 could be integrally formed with the release lever 61 as one-piece when the child-lock mechanism is not necessary.

Figure 7:
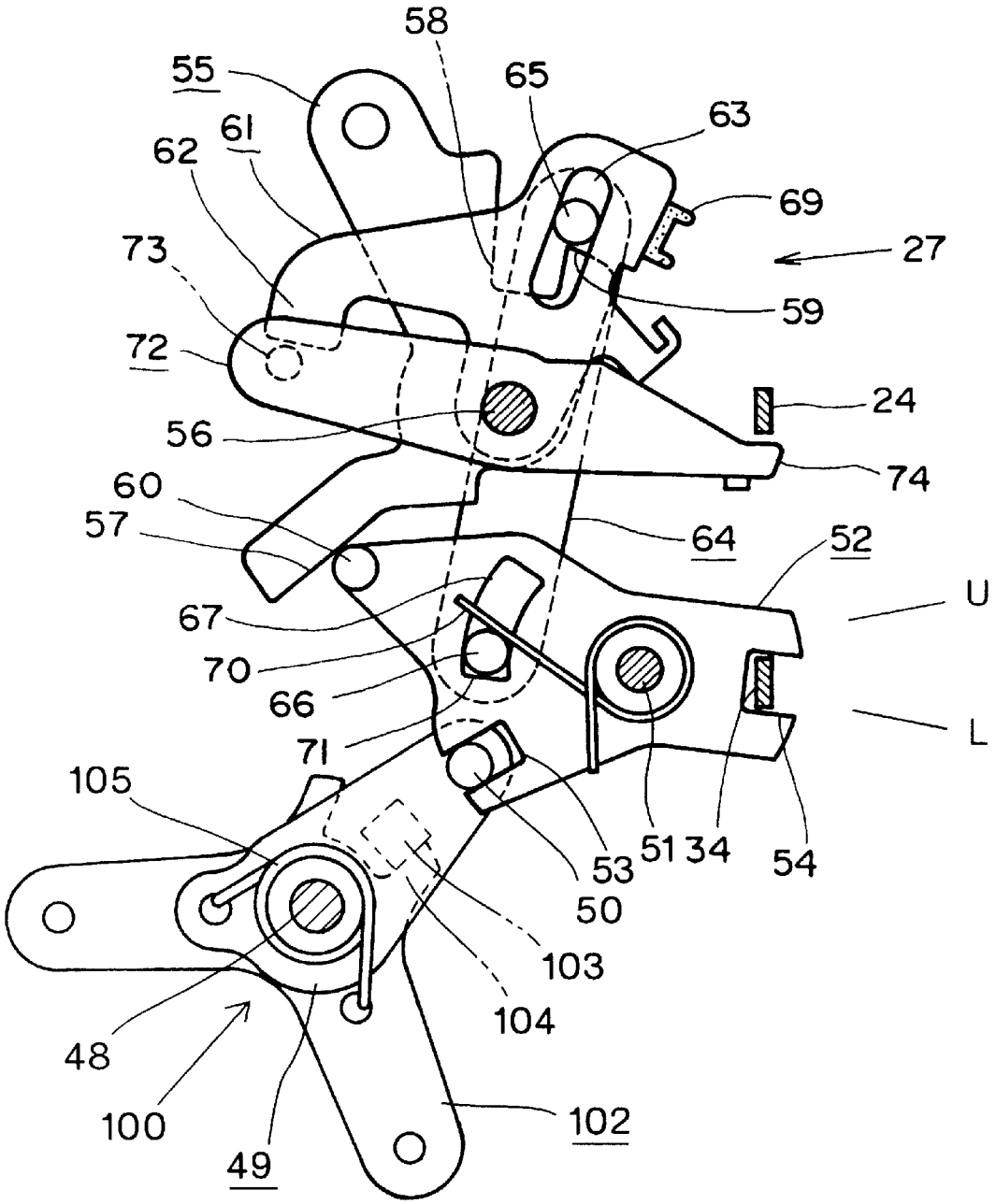
FIG. 7 is a segmentary side view of the latch assembly in which an inner lever is slightly rotated in a door-opening direction by a first door-opening actuation of an inside open handle in FIG. 5.

The operation of the DA mechanism 27 will now be explained. In the locked state of FIG. 5, even if turning the inner lever 55 counterclockwise by the first door-opening actuation of the inside open handle 28, the release lever 61 is not turned due to the disengagement of the slide pin 65 from the hook 58. Instead of that, by the rotational movement of the inner lever 55, the blocking surface 59 of the inner lever 55 is shifted to overlap with the elongated hole 63, and the push arm 57 of the inner lever 55 is brought into contact with the engaging projection 60 of the sub lock lever 52 to gradually turn the sub lock lever 52 counterclockwise. Thereby the main lock lever 34 is gradually displaced toward the unlocked position U from the locked position L by the engagement between the forked portion 54 of the sub lock lever 52 and the interior side end of the lock lever 34 against the elasticity of the over-center spring 42, and the slide pin 65 of the slide link 64 which is moved downward together with the sub lock lever 52 is brought into contact with the blocking surface 59 of the inner lever 55, as shown in FIG. 7. It is noted that, in the state of FIG. 7, the main lock lever 34 has not yet been exceeded the dead point of the over-center spring 42 so that the main lock lever 34 and the sub lock lever 52 are still urged by the elasticity of the over-center spring 42 toward the locked position L. Therefore the main lock lever 34, the slide pin 65 and so on are returned to the initial positions thereof shown in FIG. 5 if the first door-opening actuation of the inside handle 28 is interrupted in the state of FIG. 7.

Figure 8:
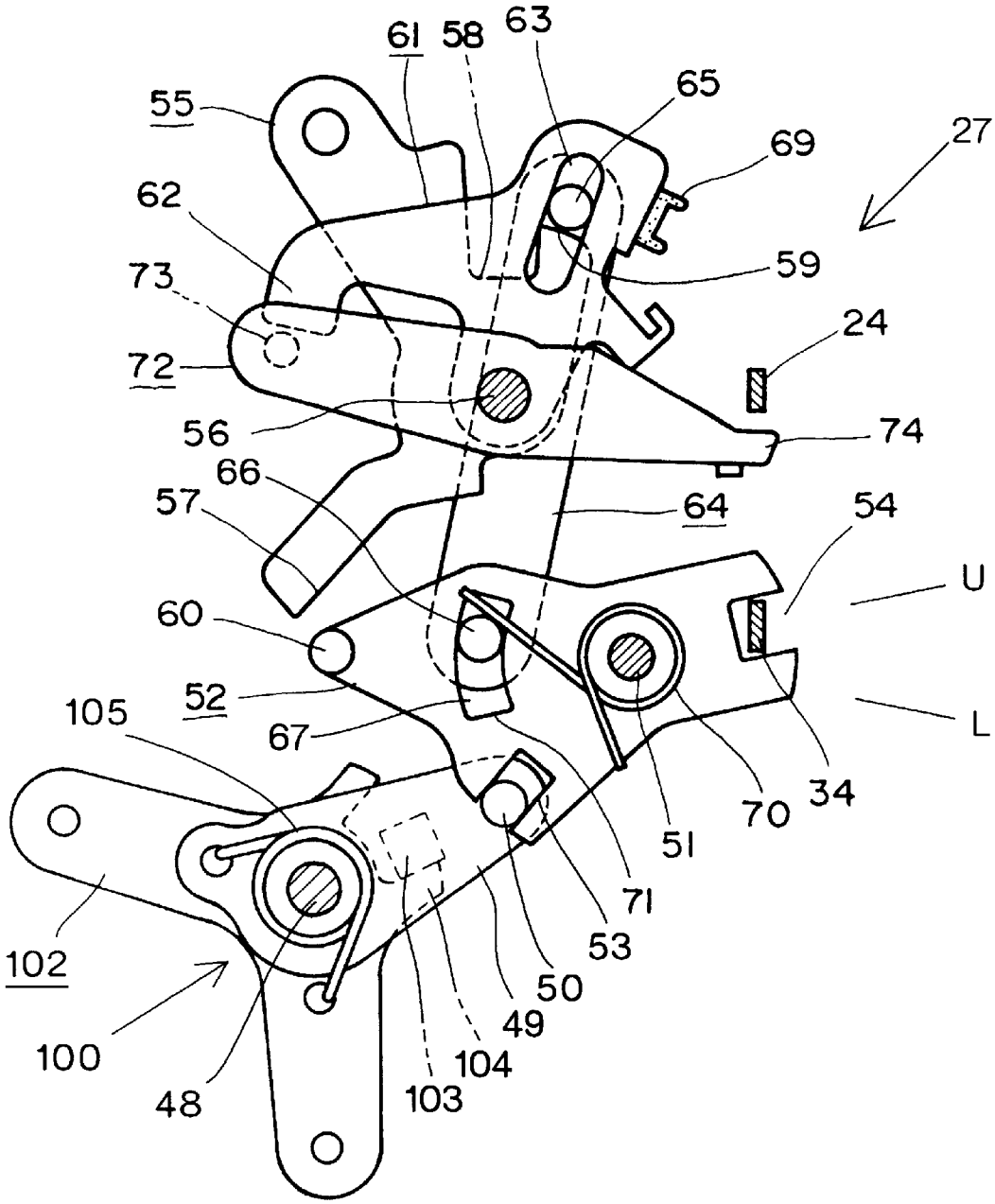
FIG. 8 is a segmentary side view of the latch assembly in which the inner lever is completely rotated in the door-opening direction in FIG. 7.

In the state of FIG. 7, when further turning the inner lever 55 counterclockwise by the first door-opening actuation of the inside open handle 28, the sub lock lever 52 is further pressed by the push arm 57 and the lock lever 34 is displaced to the unlocked position U as shown in FIG. 8, but the slide pin 65 is still in contact with the blocking surface 59. The above rotational movement of the inner lever 55 by the first door-opening actuation is called an unlocking movement.

When the sub lock lever 52 is displaced from the locked position L to the unlocked position U by the first door-opening actuation of the inner lever 55 in the locked state, the actuator lever 49 of the antitheft mechanism 100 connected to the sub lock lever 52 is also rotated clockwise, and the projection 103 of the actuator lever 49 pushes the contact portion 104 of the intermediate lever 102 to rotate the intermediate lever 102 clockwise, and as shown in FIG. 16, the inside lock button 36 is restored from the locked position L to the unlocked position U through the rod 101.

In the state of FIG. 8 where the locked state is released, when interrupting the first door-opening actuation of the inside open handle 28 and restoring the inside handle 28 to the initial position, the inner lever 55 is turned clockwise, and the slide pin 65 is then released from the restriction by the blocking surface 59, and thereby the pin 65 is moved downward by the elasticity of the spring 70 and is engaged with the hook 58 as shown in FIG. 6, and the door latch device becomes in the unlocked state.

In the unlocked state of FIG. 6, when turning the inner lever 55 counterclockwise by the second door-opening actuation of the inside open handle 28, the release lever 61 is also turned counterclockwise by the engagement between the slide pin 65 and the hook 58 of the inner lever 55, and thereby the contact arm 62 of the release lever 61 is brought into contact with the sub projection 73 of the sub inner lever 72 to turn the sub inner lever 72 counterclockwise. Then, the engaging portion 74 at the lower portion of the sub inner lever 72 is brought into contact with the interior side portion of the open lever 24 and turns the open lever 24 so as to open the door. The above rotational movement of the inner lever 55 by the second door-opening actuation is called an opening movement against the unlocking movement of the inner lever 55 in the locked state.

Advantages

As mentioned above, in the present invention, the locked state of the door latch device is prevented from being released, even when any one of the inside lock button 36, the rod 101, and the intermediate lever 102 receives the illegal access for unlocking.

What is claimed is:

1. A vehicle door latch device comprising:

an open lever for connection to an outside open handle of a vehicle door and arranged to open the door when the outside open handle is operated;

a lock lever for connection to an inside lock button of the door through a rod and displaceable between an unlocked position where it makes a door-opening movement of the open lever effective and a locked position where it makes the door-opening movement of the open lever ineffective;

an over-center spring for elastically keeping the lock lever in one of the unlocked position and the locked position;

a double action mechanism for connection to an inside open handle of the door, said double action mechanism being arranged to switch the lock lever from the locked position to the unlocked position when the inside open handle is operated while the lock lever is being in the locked position, and further being arranged to actuate the open lever when the inside open handle is operated while the lock lever is being in the unlocked position; and an antitheft mechanism having an antitheft spring with elasticity weaker than elasticity of the over-center spring, said antitheft mechanism being provided between the rod and the lock lever;

wherein said antitheft spring is arranged to be compressed without displacing the lock lever from the locked position to the unlocked position when the rod is moved in an unlocking direction by an illegal access while the lock lever is being in the locked position.

2. The vehicle door latch device according to claim 1, wherein said antitheft spring is arranged to restore the rod, by the elasticity thereof, to an original position of the rod when the rod is released from the illegal access.

3. The vehicle door latch device according to claim 1, wherein said antitheft mechanism includes a first lever which is displaced integrally with the lock lever and a second lever which is displaced integrally with the rod, and said antitheft spring includes a first leg portion engaged with the first lever and a second leg portion engaged with said second lever.

4. The vehicle door latch device according to claim 3, wherein said first lever and said second lever are held in a state of being brought into contact with each other by the elasticity of the antitheft spring.

* * * * *